US007802789B2

(12) United States Patent
Tokita et al.

(10) Patent No.: US 7,802,789 B2
(45) Date of Patent: Sep. 28, 2010

(54) SHEET CONVEYING DEVICE, SHEET PUNCHING DEVICE, SHEET PROCESSING DEVICE, IMAGE FORMING APPARATUS, AND METHOD FOR DETERMINING MOUNTING STATE OF MEASURING UNIT

(75) Inventors: Junichi Tokita, Kanagawa (JP); Masahiro Tamura, Kanagawa (JP); Nobuyoshi Suzuki, Tokyo (JP); Makoto Hidaka, Tokyo (JP); Takashi Saito, Kanagawa (JP); Hitoshi Hattori, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Akira Kunieda, Tokyo (JP); Hiroshi Maeda, Gifu (JP); Ichiro Ichihashi, Aichi (JP); Atsushi Kuriyama, Aichi (JP)

(73) Assignee: Ricoh Co., Ltd., Tokyo (JP)

( * ) Notice: Subject to any disclaimer, the term of this patent is extended or adjusted under 35 U.S.C. 154(b) by 39 days.

(21) Appl. No.: 12/320,960

(22) Filed: Feb. 10, 2009

(65) Prior Publication Data

US 2009/0206547 A1 Aug. 20, 2009

(30) Foreign Application Priority Data

Feb. 14, 2008 (JP) ..... 2008-033423

(51) Int. Cl.
*B65H 7/02* (2006.01)

(52) U.S. Cl. ..... 271/227; 271/265.01; 250/559.1; 270/58.07

(58) Field of Classification Search ..... 271/265.01, 271/265.02, 227, 228; 270/58.01, 58.02, 270/58.07; 250/559.04, 559.01, 559.1, 559.12, 250/559.29, 559.3

See application file for complete search history.

(56) References Cited

U.S. PATENT DOCUMENTS 5,166,532 A * 11/1992 Brunner et al. ..... 250/548
6,937,263 B2 * 8/2005 Namiki et al. ..... 347/248
7,306,214 B2 12/2007 Iida et al.

(Continued)

FOREIGN PATENT DOCUMENTS

JP 3363725 10/2002

(Continued)

OTHER PUBLICATIONS

Abstract of JP 2003-177634 published Jun. 27, 2003.

(Continued)

*Primary Examiner*—Kaitlin S Joerger
(74) *Attorney, Agent, or Firm*—Harness, Dickey & Pierce, P.L.C.

(57) ABSTRACT

A sheet conveying device includes a conveying unit that conveys a sheet in a sheet conveying direction; a measuring unit that measures a position of a side edge of the sheet in a measurement area; a shielding unit having an end portion that is projected into the measurement area for shielding the sheet; a first determining unit that determines whether the shielding unit is detectable in the measurement area; and a second determining unit that determines whether the measuring unit has been mounted in the sheet conveying device based on a result obtained in the first determining unit.

18 Claims, 13 Drawing Sheets

U.S. PATENT DOCUMENTS

| | | | | |
|---|---|---|---|---|
| 7,410,158 | B2 | 8/2008 | Iida et al. | |
| 7,578,498 | B2 * | 8/2009 | Iguchi et al. | 270/58.07 |
| 7,624,976 | B2 * | 12/2009 | Koie | 270/58.12 |
| 2004/0256783 | A1 | 12/2004 | Iida et al. | |
| 2008/0204824 | A1 * | 8/2008 | Tokida et al. | 358/496 |
| 2008/0236351 | A1 * | 10/2008 | Hidaka et al. | 83/73 |
| 2008/0290830 | A1 | 11/2008 | Hattori et al. | |
| 2008/0309006 | A1 * | 12/2008 | Iguchi et al. | 271/227 |
| 2009/0060604 | A1 * | 3/2009 | Hattori et al. | 399/361 |

FOREIGN PATENT DOCUMENTS

| | | |
|---|---|---|
| JP | 2003-248410 | 9/2003 |
| JP | 3848147 | 9/2006 |
| JP | 2006-293280 | 10/2006 |

OTHER PUBLICATIONS

Abstract of JP 10-194557 published Jul. 28, 1998.

* cited by examiner

L: DISTANCE DETECTED BY LATERAL REGISTRATION SENSOR
M: DESIGNATED DISTANCE
x: MISREGISTRATION AMOUNT (M−L)

MISREGISTRATION AMOUNT FROM HOME POSITION=7.5−x [mm]

SHEET CONVEYING DEVICE, SHEET PUNCHING DEVICE, SHEET PROCESSING DEVICE, IMAGE FORMING APPARATUS, AND METHOD FOR DETERMINING MOUNTING STATE OF MEASURING UNIT

CROSS-REFERENCE TO RELATED APPLICATIONS

The present application claims priority to and incorporates by reference the entire contents of Japanese priority document 2008-033423 filed in Japan on Feb. 14, 2008.

BACKGROUND OF THE INVENTION

1. Field of the Invention

The present invention relates to a sheet conveying device, a sheet punching device, a sheet processing device, an image forming apparatus, and a sheet conveying method to be implemented in the sheet conveying device, the sheet processing device, and the image forming apparatus.

2. Description of the Related Art

In a typical sheet post-processing apparatus, a punching unit measures a position of a side edge of a sheet-like recording medium (hereinafter, "sheet"), and decides a punching position on the sheet based on the measured position of the side edge. This approach allows accurate setting of the punching position. Related technologies have been disclosed in, for example, Japanese Patent No. 3363725 and Japanese Patent Application Laid-open No. 2003-248410.

Japanese Patent No. 3363725 discloses a conventional punching device that measures a position of a side edge of a sheet and decides a punching position based on the measured position of the side edge. Specifically, the punching device includes a punching unit that is movable in a punching direction that is perpendicular to a sheet conveying direction and can punch a conveyed sheet at a desired position; a detecting unit that detects a side edge of a sheet conveyed to the punching unit in the sheet conveying direction; and a moving unit that moves the punching unit in the punching direction based on the position of the side edge detected by the detecting unit. In particular, the detecting unit is moved in advance to a position near the side edge of the conveyed sheet based on information about a size of the sheet.

However, with the current increase in the sheet conveying speed and the printing speed, the time available for moving the detecting unit to the side edge of the conveyed sheet is becoming shorter and shorter. Therefore, it is technically difficult to move the detecting unit in punching units with fast processing speed. To take care of this issue, a contact image sensor (CIS) is now a days used in image forming apparatuses for measuring a position of the side edge of a conveyed sheet. For example, Japanese Patent Application Laid-open No. 2003-248410 discloses a conventional technology in which a CIS is used to detect a side edge of a conveyed sheet. Specifically, the CIS is arranged in a sheet-conveying area such that reading pixels of the CIS are aligned in a direction substantially perpendicular to a sheet conveying direction. One-seventh of the total reading pixels are repeatedly read in a shorter period (TS) to detect a leading end of a conveyed sheet. After a predetermined waiting time has elapses from a timing of detection of the leading end of the sheet, image writing in a sub-scanning direction is started by irradiating a laser onto a photosensitive element. Meanwhile, six-seventh of the total reading pixels are read in a longer period to detect a lateral position of the conveyed sheet. A misregistration amount is calculated based on the detected lateral position, and a writing position in a main-scanning direction on the sheet is corrected based on the misregistration amount.

In this manner, a processing speed for detecting a side edge of a sheet can be improved by using the CIS. However, such an advantage can be achieved only when the CIS is mounted properly with good precision. Therefore, it is necessary to check, after mounting the CIS, whether the CIS has been mounted properly. One method of checking whether the CIS is mounted properly is as follows. That is, a sheet is set in an offset manner in a sheet feeding unit of an image forming apparatus, and an image is formed on the sheet on a trial basis to see whether image-misalignment occurs.

The above technique can be used if a CIS is mounted in an image forming apparatus right from the beginning, i.e., during assembly of the image forming apparatus. However, a CIS can be provided in a punching unit of a sheet post-processing apparatus, i.e., at a later stage of assembly of the image forming apparatus, for improvement of the accuracy of the punching position. Because a punching unit is often an optional device to be installed depending on a request from users, the punching unit is generally set and checked by a field service person at a customer location, so that assembly error or checking failure is likely to occur. The accuracy of the punching position also depends on how a sheet is conveyed. For example, if a sheet is conveyed without skew or lateral misregistration, the accuracy of the punching position will be better. Therefore, whether a CIS is operating normally, or a CIS has been mounted at all, cannot always be checked by printing an image on a sheet on a trial basis as in the above technique. In other words, the above technique is not always effective to determine whether a measuring unit for measuring a position of a side edge of a sheet is operating normally, or whether the measuring unit has been mounted at all in the apparatus.

SUMMARY OF THE INVENTION

It is an object of the present invention to at least partially solve the problems in the conventional technology.

According to an aspect of the present invention, there is provided a sheet conveying device including a conveying unit that conveys a sheet in a sheet conveying direction; a measuring unit that measures a position of a side edge of the sheet in a measurement area; a shielding unit having an end portion that is projected into the measurement area for shielding the sheet; a first determining unit that determines whether the shielding unit is detectable in the measurement area; and a second determining unit that determines whether the measuring unit has been mounted in the sheet conveying device based on a result obtained in the first determining unit.

According to another aspect of the present invention, there is provided a method for determining whether a measuring unit is mounted in a sheet conveying device that includes a conveying unit that conveys a sheet in a sheet conveying direction; a measuring unit that measures a position of a side edge of the sheet in a measurement area; and a shielding unit having an end portion that is projected into the measurement area for shielding the sheet. The method includes first determining including determining whether the shielding unit is detectable in the measurement area; and second determining including determining whether the measuring unit is mounted based on a result obtained at the first determining.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

In the following embodiments, a conveying unit corresponds to conveying (entrance) rollers 1, a measuring unit corresponds to a lateral registration sensor 414 and a contact image sensor (CIS) 201, a measurement area corresponds to a reading range (measurement area) R, a shielding unit corresponds to a shielding plate 202, a determining unit corresponds to a CPU 111, and an operation panel corresponds to an operation panel 113.

Figure 1:
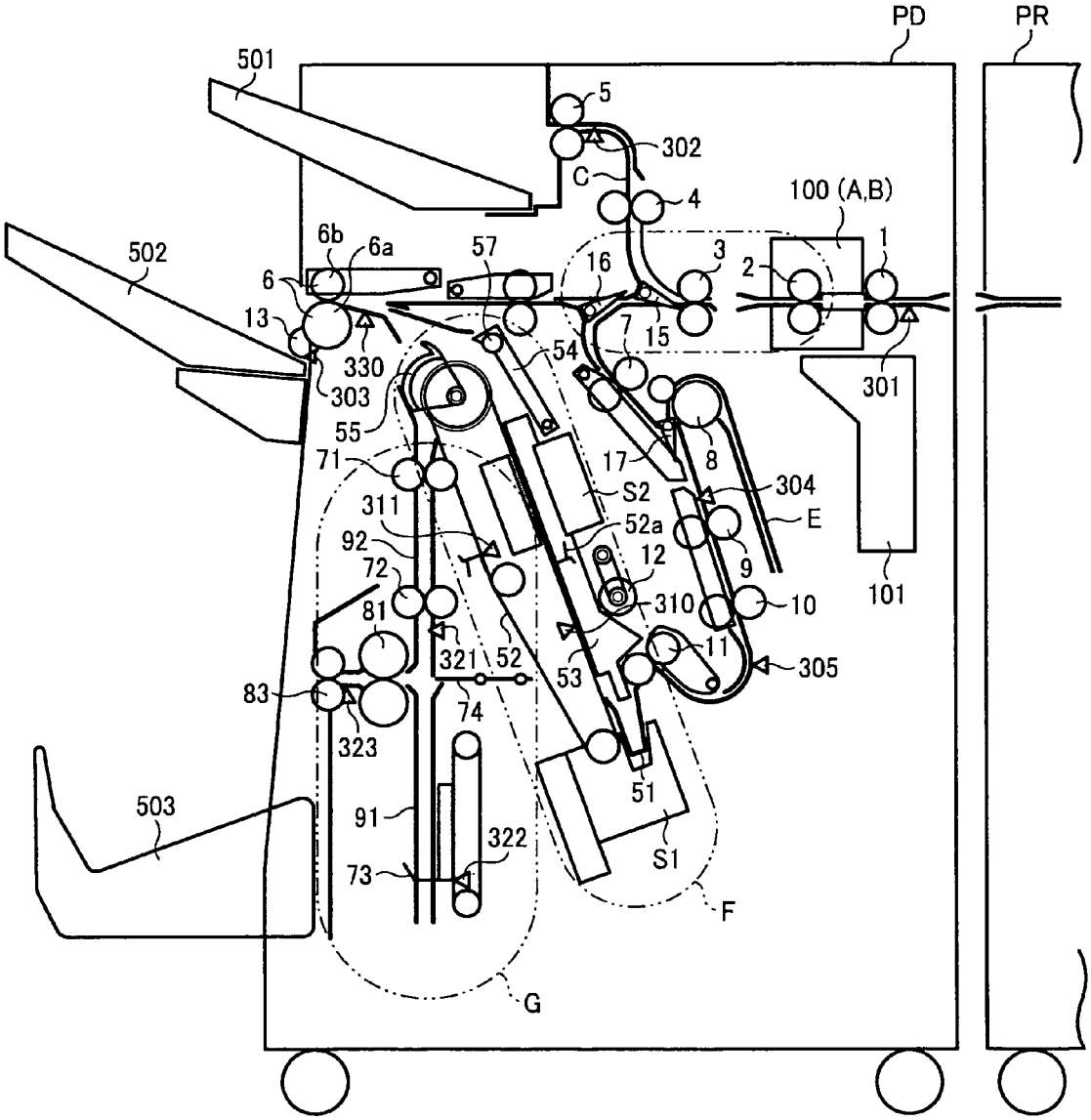
FIG. 1 is a schematic diagram of a printing system including a sheet post-processing apparatus and an image forming apparatus according to an embodiment of the present invention.

FIG. 1 is a schematic diagram of a printing system including a sheet post-processing apparatus PD as a sheet finisher and an image forming apparatus PR according to an embodiment of the present invention. In FIG. 1, the entire configuration of the sheet post-processing apparatus PD and only a part of the image forming apparatus PR are shown.

The sheet post-processing apparatus PD is coupled to the image forming apparatus PR, and receives a recording medium, such as a sheet, from the image forming apparatus PR. The sheet then passes through a conveying path including a post processing unit (in the embodiment, a punching device 100) that performs post processing on the sheet. Then, the sheet is conveyed to any one of a conveying path for guiding the sheet to an upper tray 501, a conveying path for guiding the sheet to a shift tray 502, and a conveying path for guiding the sheet to a processing tray F (hereinafter, referred to as "staple processing tray F") that performs aligning and stapling, by a branching claw 15 and a branching claw 16.

Sheets that are guided by the branching claws 15 and 16 to the staple processing tray F where the sheets are aligned and stapled are then conveyed as a stapled sheet stack to either a conveying path for guiding the sheets to the shift tray 502 or a processing tray G (hereinafter, referred to as "center-folding tray G") for folding the stapled sheet stack, by a branching guide plate 54 and a movable guide 55 that function as a deflecting unit. The stapled sheet stack that is center-folded in the center-folding tray G is guided to a lower tray 503 via a sheet discharging path. A branching claw 17 is arranged in a conveying path from the branching claw 16 to the staple processing tray F. The branching claw 17 is maintained in the state shown in FIG. 1 by a low-load spring (not shown). After a trailing end of a sheet conveyed by a pair of conveying rollers 7 passes the branching claw 17, the sheet is conveyed backward with a pair of prestack rollers 8 due to reverse rotation of at least a pair of conveying rollers 9 out of the conveying rollers 9, a pair of conveying rollers 10, and a pair of staple sheet discharge rollers 11 so that the trailing end of the sheet is guided to and temporarily held in a sheet storage unit E. When a next sheet is conveyed, the next sheet is stacked on the preceding sheet and temporarily held in the sheet storage unit E in the same manner. In this manner, a stack of sheets to be stapled is prepared inside the sheet storage unit E and finally conveyed to the staple processing tray F. It is also possible to stack and convey three or more sheets in an overlapped manner by repeating the above operation. A sheet sensor 304 is arranged on the upstream side of the conveying rollers 9 in a sheet conveying direction and a sheet detection sensor 305 is arranged on the downstream side of the conveying rollers 10 in the sheet conveying direction for detecting the trailing end of the sheet.

An entrance sensor 301 detects entry of a sheet in the sheet post-processing apparatus PD from the image forming apparatus PR. A pair of entrance (conveying) rollers 1, the punching device 100, a pair of conveying rollers 2, the branching claw 15, and the branching claw 16 are arranged in that order on the downstream side of the entrance sensor 301. The branching claws 15 and 16 are maintained in the state shown in FIG. 1 by springs (not shown). When solenoids (not shown) are turned on, the branching claw 15 rotates upward and the branching claw 16 rotates downward so that sheets can be guided to each of the above-mentioned conveying paths. A hopper 101 is arranged below the punching device 100 for collecting punching waste (dust). The hopper 101 can be removed out of the sheet post-processing apparatus PD from a door (not shown) arranged on the front side of the sheet post-processing apparatus PD, so that punching waste collected in the hopper 101 can be discarded as appropriate. The hopper 101 is provided with a full-state sensor (not shown) for detecting whether the hopper 101 is full of punching waste.

When guiding a sheet to the upper tray 501, the solenoid for the branching claw 15 is turned off to keep the state shown in FIG. 1. When guiding a sheet to a conveying path C, the solenoids for the branching claws 15 and 16 are turned on while the branching claws 15 and 16 are in the state shown in FIG. 1, so that the branching claw 15 rotates downward. As a result, the sheet is discharged onto the upper tray 501 through a pair of conveying rollers 3, a pair of conveying rollers 4, and a pair of upper discharge rollers 5. The state of a sheet being discharged is detected by an upper discharge sensor 302. When guiding a sheet to the staple processing tray F, the solenoid for the branching claw 16 is turned off to keep the state shown in FIG. 1 and the solenoid for the branching claw 15 is turned off while the branching claw 15 is in the state shown in FIG. 1, so that the branching claw 15 rotates upward.

The sheet post-processing apparatus PD is capable of performing various kinds of processing on sheets such as punching (using the punching device 100), aligning and side-stitching, i.e., stapling an side-stitching (using a jogger fence 53 and an side-stitching stapler S1), aligning and saddle stitching (using the jogger fence 53 and a saddle-stitching stapler S2), sorting (using the shift tray 502), and center folding (using a folding plate 74 and a pair of folding rollers 81).

A shift-tray sheet discharge unit for discharging sheets onto the shift tray 502 includes a pair of shift sheet discharge rollers 6, a return roller 13, a sheet surface sensor 330, the shift tray 502, a shift mechanism (not shown), and shift-tray lifting mechanism (not shown). One of the shift sheet discharge rollers 6 serves as a driving roller 6*a* and the other serves as a driven roller 6*b*. The driven roller 6*b* is attached to a free end of an open-close guide plate. The open-close guide plate is rotatable around a fulcrum that is the other end located on the upstream side in the sheet conveying direction. The driven roller 6*b* comes into contact with the driving roller 6*a* by gravity or a biasing force, so that a sheet being discharged is nipped between the driving roller 6*a* and the driven roller 6*b*. If a stapled sheet stack is discharged, the open-close guide plate is lifted upward and then downward to a stop position at a predetermined timing. The predetermined timing is determined based on a detection signal from a shift sheet discharge sensor 303. The stop position is determined based on a detection signal from a discharging-guide-plate open-close sensor (not shown). The guide plate is driven by a discharging-guide-plate open-close motor (not shown).

The staple processing tray F that performs staple processing is configured and operates as follows. That is, sheets discharged by the staple sheet discharge rollers 11 are sequentially stacked on the staple processing tray F. Every time a sheet is stacked on the staple processing tray F, the sheet is aligned in a longitudinal direction (a sheet conveying direction) by a tapping roller 12 and aligned in a lateral direction (a direction perpendicular to the sheet conveying direction, i.e., a sheet width direction) by the jogger fence 53. The side-stitching stapler S1 is driven to perform side-stitching in response to a stapling signal from a control device during the time between jobs, i.e., between the time when the last sheet of the present sheet stack is received and the time when the first sheet of the next sheet stack is received. Immediately thereafter, the side-stitching stapled sheet stack is conveyed to the shift sheet discharge rollers 6 by a discharge belt 52, from which discharge claws 52*a* are projected, and is discharged onto the shift tray 502 set at a position for receiving the sheet stack.

A home position of the discharge claw 52*a* is detected by a discharge-belt HP sensor 311. The discharge-belt HP sensor 311 is turned on and off by the discharge claw 52*a*. In the embodiment, the two discharge claws 52*a* are arranged on the outer circumferential surface of the discharge belt 52 at oppositely spaced positions, and alternately convey a sheet stack out of the staple processing tray F. The leading end of a sheet stack in the staple processing tray F can be aligned by using a front end of the discharge claw 52*a* through which the sheet stack is to be conveyed and a rear end of the other discharge claw 52*a* by reversely rotating the discharge belt 52. In other words, the discharge claws 52*a* also serve as an aligning unit for aligning a sheet stack in the sheet conveying direction.

The discharge belt 52 and a drive pulley are arranged on a drive shaft of the discharge belt 52 that is driven by a discharge motor (not shown), along a center line of a sheet in a sheet width direction. A plurality of discharge rollers 56 is arranged and fixed symmetrically with respect to the drive pulley. The circumferential speed of the discharge rollers 56 is set to be higher than that of the discharge belt 52. The tapping roller 12 rotates around a fulcrum by a tapping solenoid (SOL). The tapping roller 12 intermittently taps a sheet fed into the staple processing tray F to bring the sheet into contact with a trailing end fence 51. The tapping roller 12 rotates counterclockwise. The jogger fence 53 is driven by a jogger motor (not shown) capable of rotating reversely via a timing belt and reciprocates in the sheet width direction.

The side-stitching stapler S1 is driven by a stapler-moving motor (not shown) that can run reversely via the timing belt (not shown). The side-stitching stapler S1 is moved in the sheet width direction to staple a sheet stack at a predetermined end position. A stapler-moving HP sensor that detects a home position of the side-stitching stapler S1 is arranged on one end of a movable range of the side-stitching stapler S1. A stapling position of the sheet stack in the sheet width direction is controlled based on the moving amount of the side-stitching stapler S1 from the home position. The saddle-stitching stapler S2 is arranged such that the distance from the trailing end fence 51 to a stapling position by the saddle-stitching stapler S2 is equal to or longer than half of the length of a sheet of the maximum size that can be saddle-stitched. Furthermore, two saddle-stitching staplers S2 are arranged symmetrically with respect to the center line of a sheet in a sheet width direction and fixed to a stay. The saddle-stitching stapler S2 has a known configuration and therefore detailed explanation is omitted. When performing saddle stitching, the jogger fence 53 aligns the sheets in a direction perpendicular to the sheet conveying direction, and the trailing end fence 51 and the tapping roller 12 align the sheets in the sheet conveying direction. Thereafter, the discharge belt 52 is driven to lift a stack of the sheets while the discharge claw 52*a* supports the trailing end of the sheet stack until the center of the sheet stack is positioned to the stapling position by the saddle-stitching staplers S2. Then, the discharge belt 52 is stopped and the sheet stack is saddle-stitched by the saddle-stitching staplers S2. The saddle-stitched sheet stack is conveyed to the center-folding tray G to be center-folded. In FIG. 1, reference numeral 310 is a sheet sensor that detects a sheet on the staple processing tray F.

The sheet stack that is stapled in the staple processing tray F is center-folded at the center of the sheet stack in the center-folding tray G. To perform center folding, the stapled sheet stack needs to be conveyed to the center-folding tray G. In the embodiment, a sheet stack deviation unit is provided on the most downstream side of the staple processing tray F in the sheet conveying direction so that the saddle-stitched sheet stack is conveyed from the staple processing tray F to the center-folding tray G for center folding. The sheet stack deviation unit includes the branching guide plate 54 and the movable guide 55. The branching guide plate 54 is provided to be swingable around a fulcrum upwardly and downwardly, and a rotatable pressing roller 57 is provided on the downstream side of the branching guide plate 54. The branching guide plate 54 is pressed toward the discharge rollers 56 by a spring (not shown). The position of the branching guide plate 54 is determined based on a contact position between the branching guide plate 54 and the surface of a cam (not shown) that is driven to rotate by a sheet-stack branching motor (not shown). The movable guide 55 is swingably supported by the rotation shaft of the discharge rollers 56 such that one end of the movable guide 55 (on the side opposite to the branching guide plate 54) is driven and a stop position is set by a link arm (not shown) that is rotatably connected to a connecting unit (not shown).

The center-folding tray G includes an upper sheet-stack guide plate 92, a lower sheet-stack guide plate 91, a pair of upper sheet-stack conveying rollers 71, a pair of lower sheet-stack conveying rollers 72, the folding rollers 81, a sheet-discharging path, a lower discharge roller 83, the folding plate 74, a movable trailing end fence 73, a lifting mechanism, a sheet-stack arrival sensor 321, an HP sensor 322, and a folding-unit passage sensor 323.

The upper sheet-stack guide plate 92 and the lower sheet-stack guide plate 91 are arranged in a direction substantially perpendicular to the outer circumference of the movable guide 55 mounted on the discharge rollers 56. The upper sheet-stack conveying rollers 71 and the lower sheet-stack conveying rollers 72 are arranged on the upper sheet-stack guide plate 92. The folding rollers 81 are arranged on the adjacent portion of the upper sheet-stack guide plate 92 and the lower sheet-stack guide plate 91. The sheet-discharging path is extended from a nip of the folding rollers 81 in a horizontal direction. The folding plate 74 reciprocates in a horizontal direction with respect to the nip of the folding rollers 81 so that a sheet stack is folded and tucked into the nip of the folding rollers 81. The movable trailing end fence 73 is projected from the lower sheet-stack guide plate 91. The lifting mechanism lifts the movable trailing end fence 73 up and down. The sheet-stack arrival sensor 321 is arranged at a position on the downstream side of the lower sheet-stack conveying rollers 72 and the upstream side of a position where a sheet stack is to be folded. The HP sensor 322 is provided for detecting a home position of the movable trailing end fence 73. The folding-unit passage sensor 323 is provided for detecting a sheet stack passing through the sheet-discharging path.

In the embodiment, it is assumed that a sheet stack is center-folded. However, center-folding can be applied to one sheet instead of a sheet stack. In this case, a sheet is directly conveyed to the center-folding tray G after being discharged because saddle-stitching is not necessary. The sheet conveyed to the center-folding tray G is center-folded by the folding plate 74 and the folding rollers 81, and then discharged on the lower tray 503.

Figure 2:
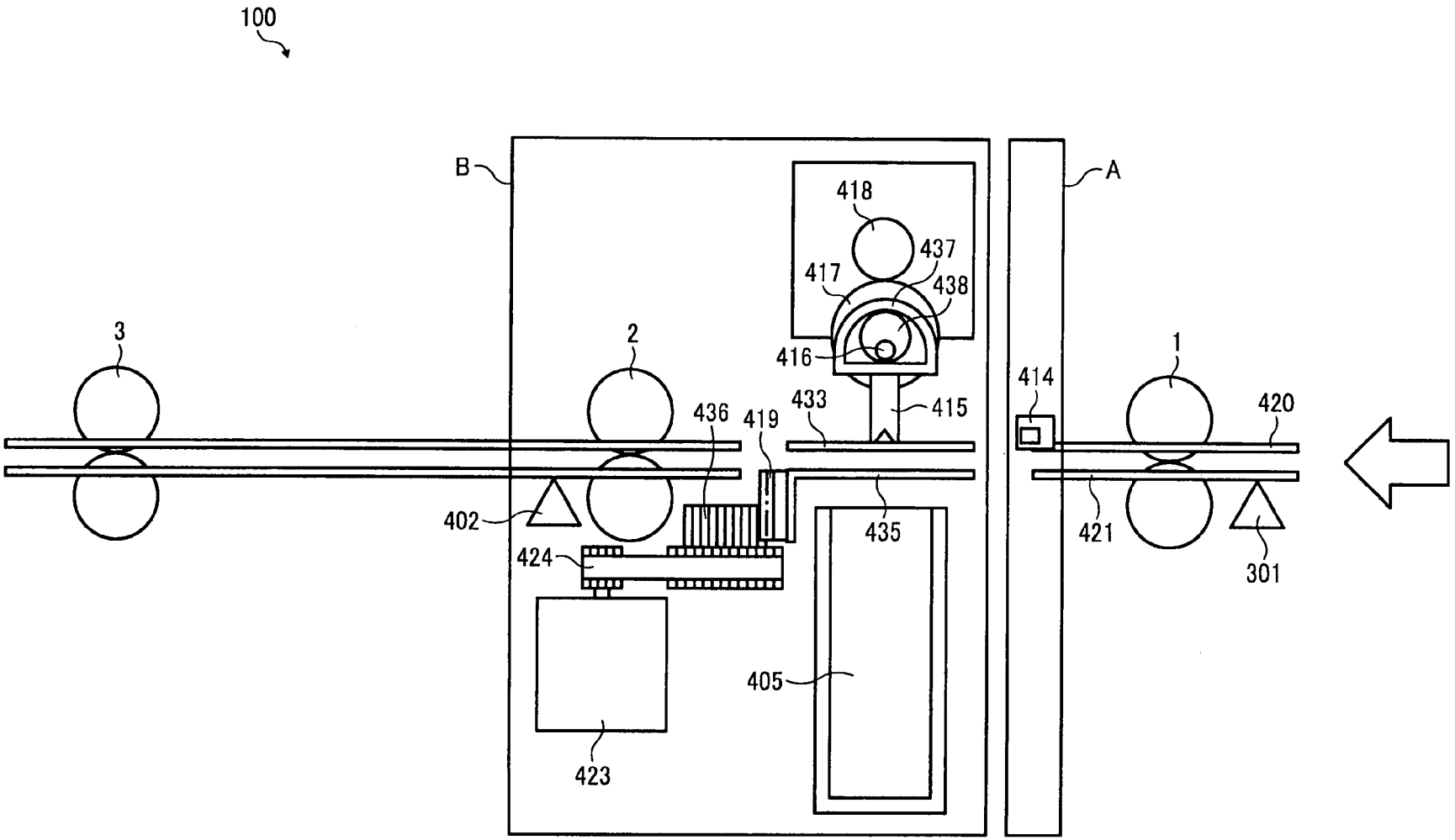
FIG. 2 is a schematic diagram of a lateral-registration detecting unit and a punching unit according to the embodiment.
Figure 3:
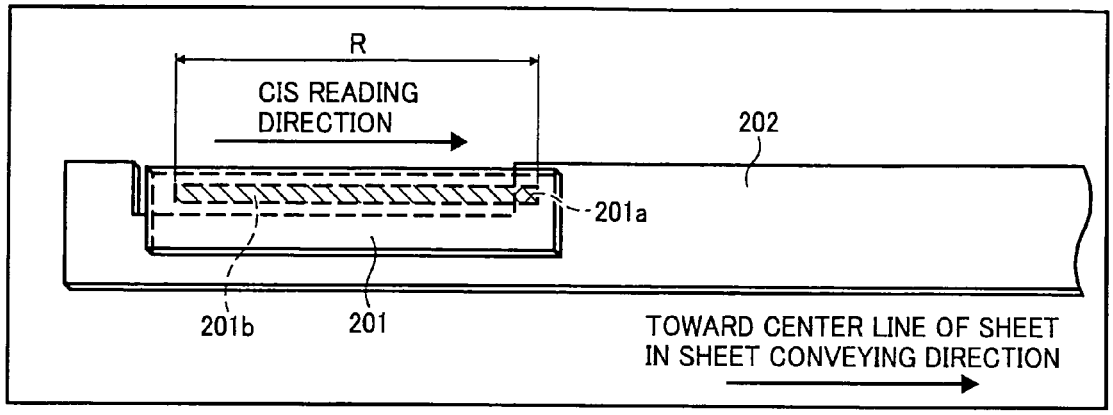
FIG. 3 is a schematic diagram illustrating a positional relation between a contact image sensor (CIS) and a shielding plate according to the embodiment.
Figure 4:
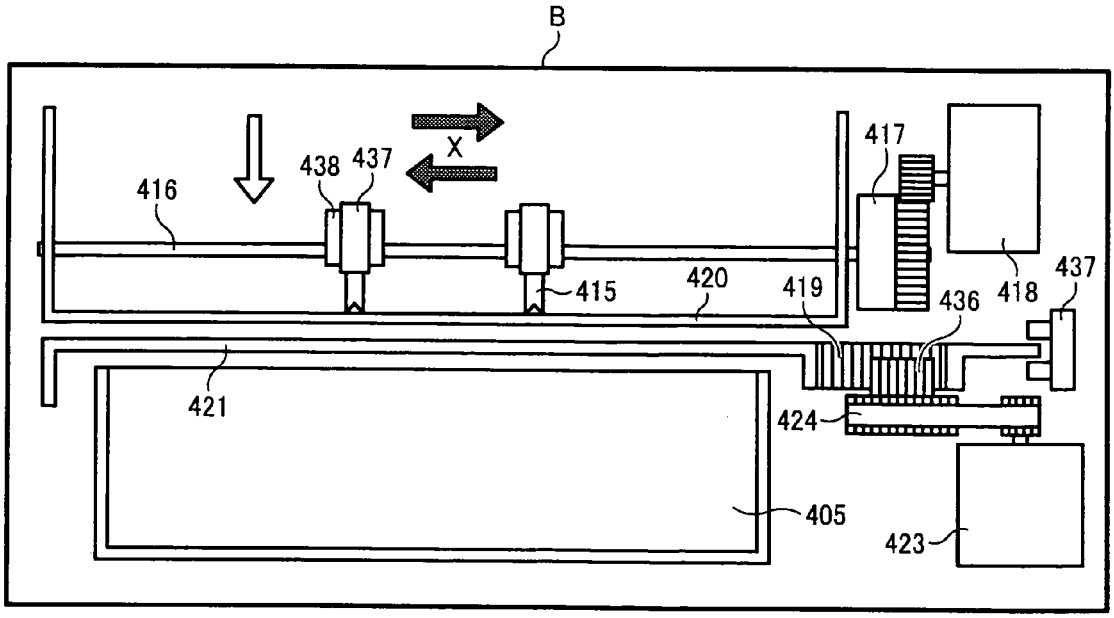
FIG. 4 is a schematic diagram of the punching unit shown in FIG. 2.

As shown in FIG. 2, the punching device 100 includes a lateral-registration detecting unit A and a punching unit B, FIG. 3 is a schematic diagram illustrating a positional relation between the CIS 201 and the shielding plate 202, and FIG. 4 is a side view of the punching unit B.

The punching unit B includes a punching blade 415, a holder 437 integrally arranged on an upper end portion of the punching blade 415, a cam 438 inserted into the holder 437 and eccentrically engaged with a shaft 416, a motor 418 that drives the punching blade 415, a second stepping motor 423 that moves the punching blade 415 in a direction perpendicular to the sheet conveying direction, a timing belt 424, a gear/pulley 436, a rack 419, an upper guide plate 433, a lower guide plate 435, and a paper sensor 402. A punching-waste guide 405 is arranged below the punching blade 415. This punching-waste guide 405 guides punching waste to the hopper 101. Reference numeral 420 denotes an upper punching guide and reference numeral 421 denotes a lower punching guide.

In the sheet post-processing apparatus PD configured as described above, a leading end of a sheet fed from the image forming apparatus PR is brought into contact with a nip of the entrance rollers 1 (hereinafter, referred to as "skew-correction rollers 1" as appropriate) that are not rotating. The sheet is continuously pressed towards the nip for a predetermined time until the sheet is bent by an adequate amount. Thereafter, the skew-correction rollers 1 are driven to rotate, whereby the sheet is conveyed. A stop time and a rotation start timing of the skew-correction rollers 1 are determined based on detection of a leading-end of the sheet by the entrance sensor 301 as a trigger. The sheet that has been aligned due to skew correction by the skew-correction rollers 1 first enters the lateral-registration detecting unit A and then enters the punching unit B.

The lateral-registration detecting unit A includes the CIS 201 as a sheet-end measuring unit that detects a position of a side edge, or a lateral end, of a sheet conveyed to the lateral-registration detecting unit A. The side edge, or the lateral end, of a sheet is a side of the sheet that is parallel to the sheet conveying direction. The CIS 201 is arranged on a sheet guide (not shown) such that a reading line direction of the CIS 201 becomes perpendicular to the sheet conveying direction. In the embodiment, the CIS 201 is used as the sheet-end-position measuring unit. However, a line sensor, or a charge coupled device (CCD) sensor, can be used instead of the CIS 201.

The second stepping motor 423 serves as a driving source of the punching unit B, and rotates the gear/pulley 436 by applying a driving force via the timing belt 424. A gear provided in the gear/pulley 436 is engaged with the rack 419, so that the rack 419 moves in directions indicated by arrows X in FIG. 4 due to rotation of the gear/pulley 436. The rack 419 is mounted on the lower punching guide 421. The components that punch a sheet (the punching blade 415, the upper punching guide 420, the shaft 416, the cam 438, the holder 437, a clutch 417, and the motor 418) are connected to the lower punching guide 421. Therefore, the above components are moved in a direction (the direction indicated by the arrows X in FIG. 4) perpendicular to the sheet conveying direction by moving the rack 419.

Figure 5:
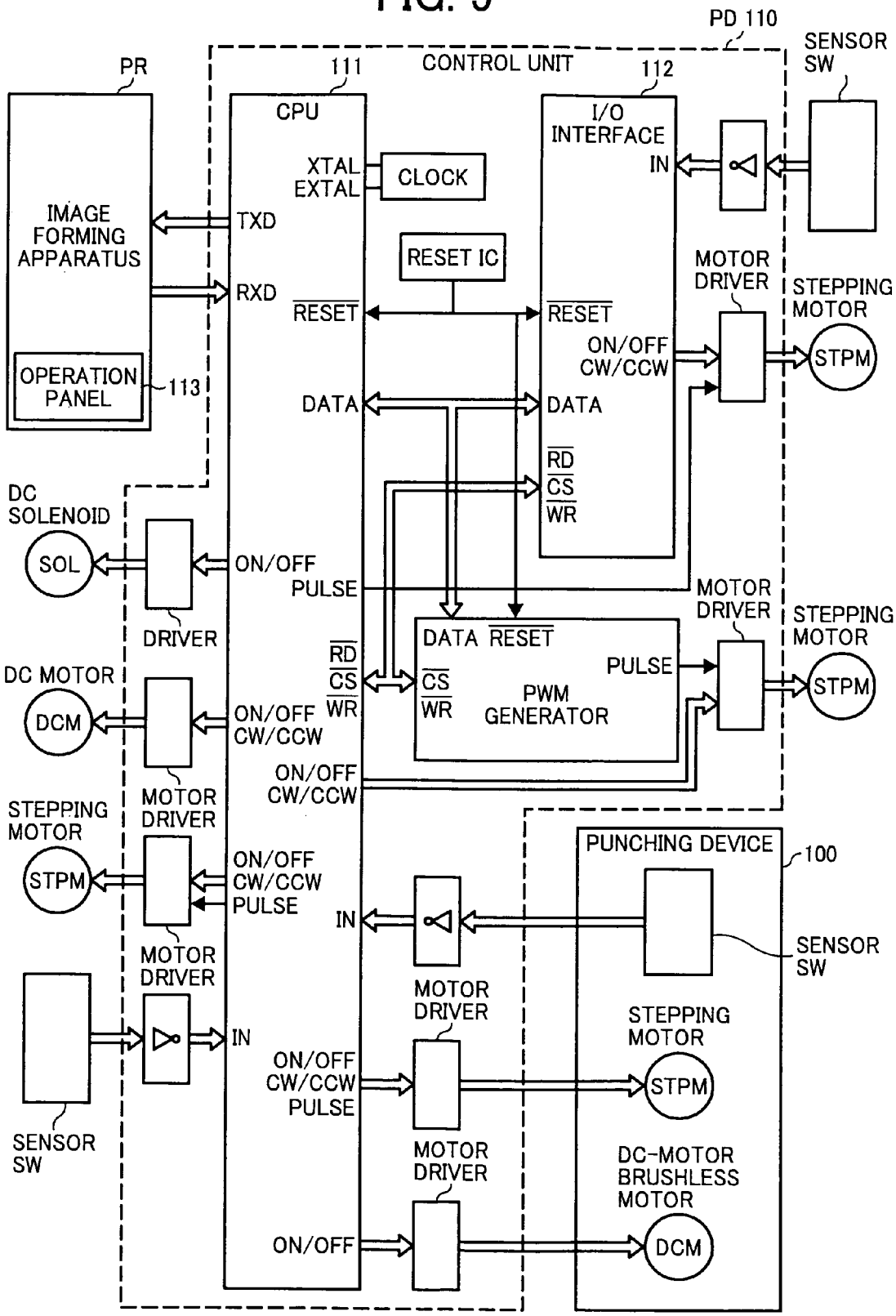
FIG. 5 is a block diagram of an electrical configuration of the printing system shown in FIG. 1.

As shown in FIG. 5, the control unit 110 is a microcomputer that includes the CPU 111, an input-output (I/O) interface 112, and the like. The CPU 111 receives various signals via the I/O interface 112 from various devices such as switches on the operation panel 113 of the image forming apparatus PR, the upper discharge sensor 302 for detecting the state of a sheet being discharged on the upper tray 501, the shift sheet discharge sensor 303 for detecting the state of a sheet being discharged on the shift tray 502, the folding-unit passage sensor 323 for detecting the state of a sheet being discharged on the lower tray 503, and the sheet surface sensor 330 for detecting a height of a sheet surface stacked on the shift tray 502. The CPU 111 controls the following components based on the input signals. That is, the punching blade 415 is caused to move upward and downward; the jogger fence 53 is caused to move in a direction perpendicular to the sheet conveying direction; the side-stitching stapler S1 and the saddle-stitching stapler S2 are caused to perform stapling, the stapled sheet stack is caused to be discharged; the shift tray 502 is caused to move upwardly and downwardly; the tapping roller 12 is caused to tap a sheet towards the trailing end fence 51 so that the sheet is aligned in the sheet conveying direction; and the rollers 1 to 7, and 9 to 11 are caused to rotate. With the above control, the CPU 111 measures a position of a side edge of a sheet based on output from the CIS 201.

The sheet post-processing apparatus PD is controlled with the above-mentioned control in the following manner. That is, the CPU 111 loads a computer program written in a read only memory (ROM) (not shown) onto a random access memory (RAM) (not shown), and executes the computer program while storing necessary data into the RAM. Computer program data can be stored in a server or other recording media such that the computer program data can be downloaded and updated via a network or a recording-media driving device. It is applicable to have integrated configurations by, for example, incorporating the sheet post-processing apparatus PD in the image forming apparatus PR.

A sheet that has been processed by the image forming apparatus PR is conveyed to the punching device 100. At this time, the sheet often gets shifted (skewed) from a designated position, and such skew needs to be corrected to improve the accuracy of punching positions. Therefore, when a sheet is to be punched, the sheet is brought into contact with a nip between the entrance rollers 1 that are not rotating, so that a leading end of the sheet is aligned by the nip position and the skew is corrected.

Figure 6:
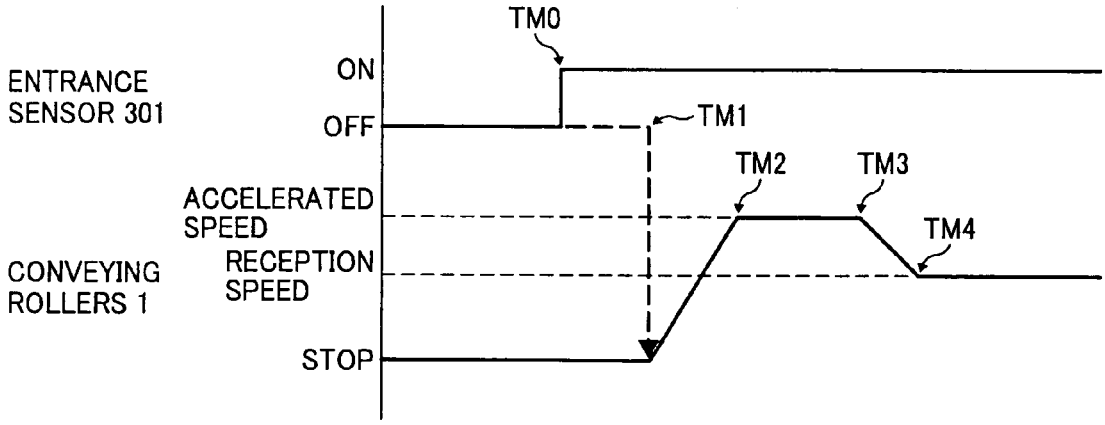
FIG. 6 is a diagram illustrating a relation between detection of a leading end of a sheet by an entrance sensor and driving of entrance (conveying) rollers when skew correction is performed.

FIG. 6 is a diagram illustrating a relation between detection of a leading end of a sheet by the entrance sensor 301 and driving of the entrance rollers 1 when skew correction is performed. A leading end of a sheet conveyed from the image forming apparatus PR makes a contact with the entrance rollers 1. In this situation, the entrance sensor 301 detects the sheet, i.e., the entrance sensor 301 is turned on. The sheet is then continuously pushed towards the nip for a predetermined time (from a timing TM0 to a timing TM1) until the sheet is bent by an adequate amount. Thereafter, the entrance rollers 1 are driven to an accelerated speed (from the timing TM1 to a timing TM2) that is faster than a reception speed, and continuously driven at the accelerated speed for a predetermined time (from the timing TM2 to a timing TM3) corresponding to the preset amount. When the sheet, which was bent, is flattened, the entrance rollers 1 are decelerated to the reception speed (from the timing TM3 to a timing TM4). Then, the entrance rollers 1 continuously rotate at the reception speed (the timing TM4 or later), whereby the sheet is conveyed. A stop time and a rotation start timing of the entrance rollers 1 are determined based on leading-end detection by the entrance sensor 301 as a trigger.

Figure 7:
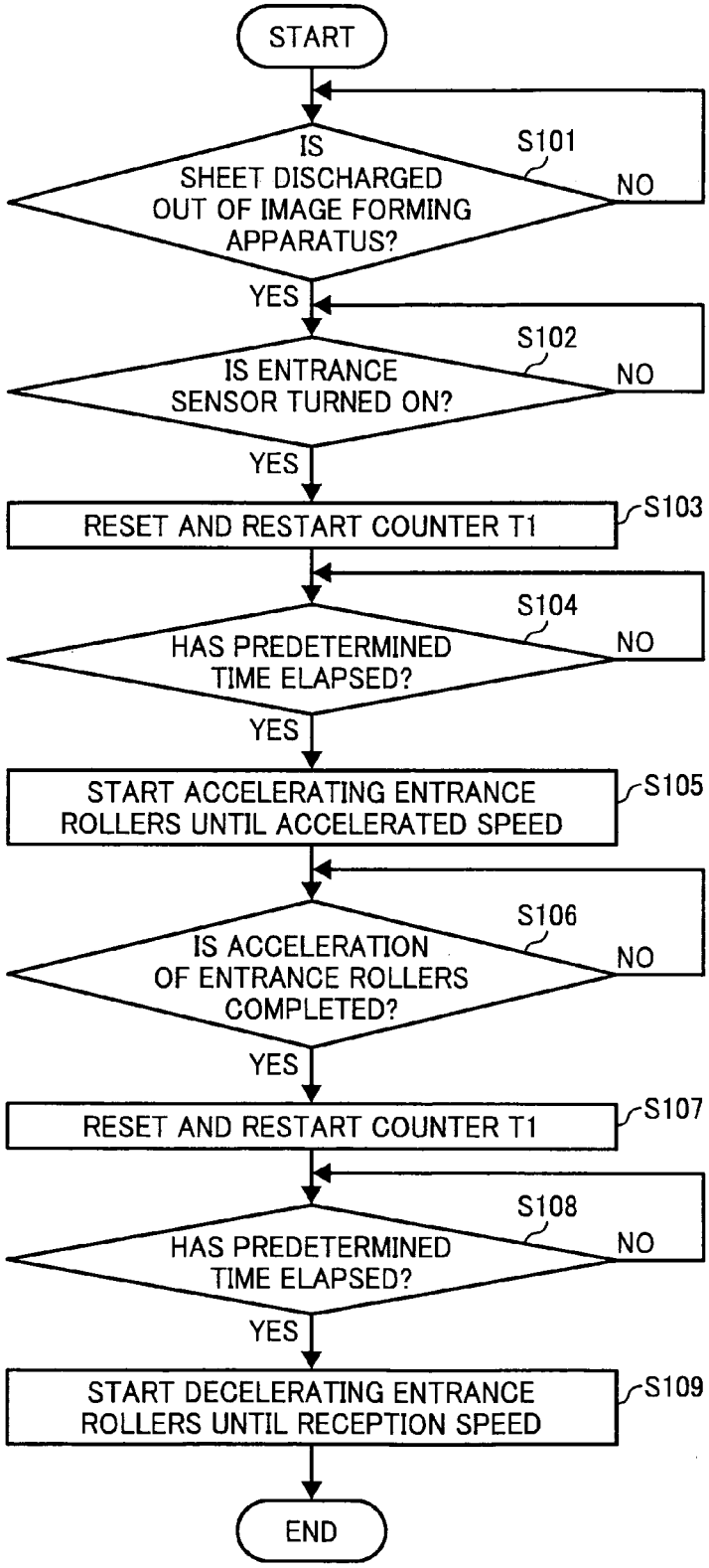
FIG. 7 is a flowchart of a control process for driving the entrance rollers.

FIG. 7 is a flowchart of a control process for driving the entrance rollers 1 when the entrance sensor 301 detects leading end of a sheet.

When a sheet is discharged out of the image forming apparatus PR (YES at Step S101) and the entrance sensor 301 is turned on (YES at Step S102), a counter T1 is reset and then restarted (Step S103). After a predetermined time (from the timing TM0 to the timing TM1) elapses (YES at Step S104), the entrance rollers 1 are accelerated to the accelerated speed (from the timing TM1 to the timing TM2: Step S105). When the acceleration is completed (at the timing TM2: YES at Step S106), the counter T1 is reset and restarted (Step S107). After a predetermined time (from the timing TM2 to the timing TM3) elapses (YES at Step S108), the entrance rollers 1 are decelerated to the reception speed (at the timing TM3: Step S109). As a result, skew of a sheet can be corrected by the entrance rollers 1.

Figure 8:
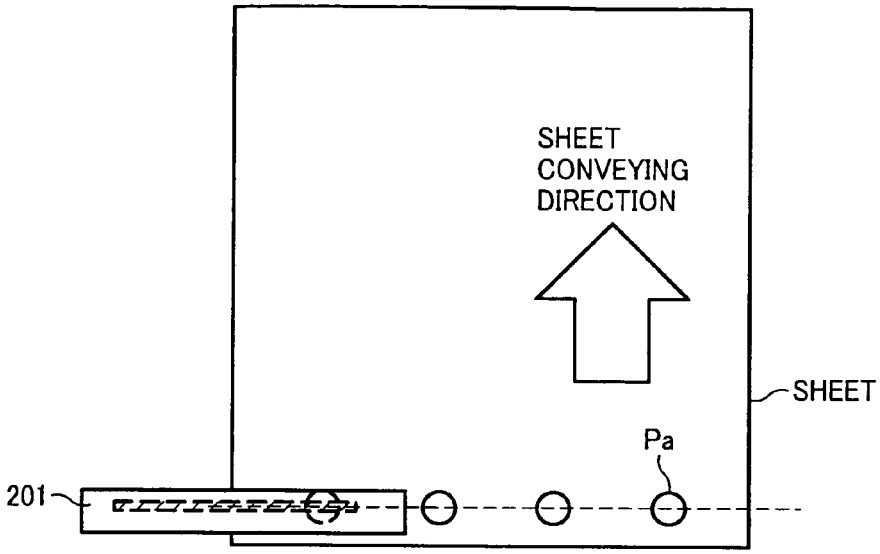
FIG. 8 is a schematic diagram for explaining a measurement start timing of the CIS with respect to a sheet.

The CIS 201 that functions as a measuring unit for measuring a position of a lateral end of a sheet acquires positional data about a lateral registration of a sheet that has been aligned by skew correction. FIG. 8 is a schematic diagram for explaining a measurement start timing of the CIS 201 with respect to a sheet. The measurement start position is preferably corresponding to a side edge of a punching hole Pa shown in FIG. 8 in a main-scanning direction so that effects due to skew can be removed as much as possible. The measurement start timing can be calculated by a timer using an ON signal (detection of a leading end of a sheet) or an OFF signal (detection of a trailing end of a sheet) from the entrance sensor 301, or by using pulse counts when the entrance rollers 1 is provided with a stepping motor as a driving source.

Figure 9:
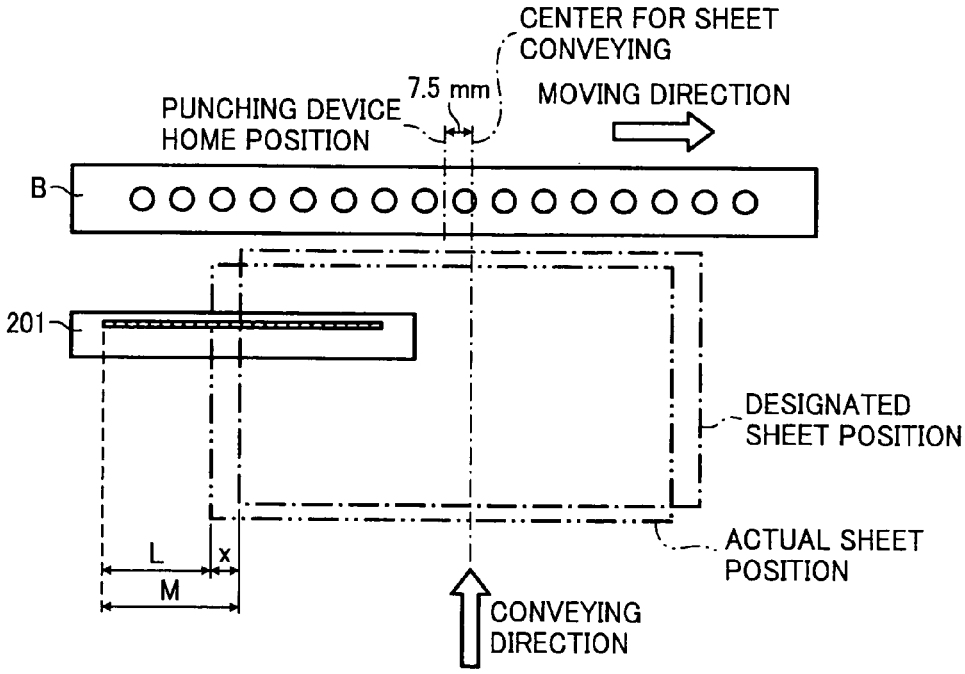
FIG. 9 is a schematic diagram illustrating a positional relation among the lateral-registration detecting unit that includes a CIS, the punching unit, and a conveyed sheet.

FIG. 9 is a schematic diagram illustrating a positional relation among the lateral-registration detecting unit A including the CIS 201, the punching unit B, and a conveyed sheet. The punching unit B is capable of moving in a direction (a moving direction indicated by an arrow in FIG. 9) perpendicular to the sheet conveying direction by the second stepping motor 423 as described above. The punching unit B controls its stop position based on a position of a conveyed sheet, so that a punching position can be accurately determined. The CIS 201 detects a distance L to the side edge of the sheet. The misregistration amount x is obtained as a difference between a designated (ideal) distance M and the measured distance L. Assuming that the designated distance M, i.e., the distance from a home position to a designated position, is 7.5 millimeters, the punching unit B moves by a distance obtained by subtracting x millimeters from 7.5 millimeters. As a result, the sheet can be punched at a correct position.

Figure 10:
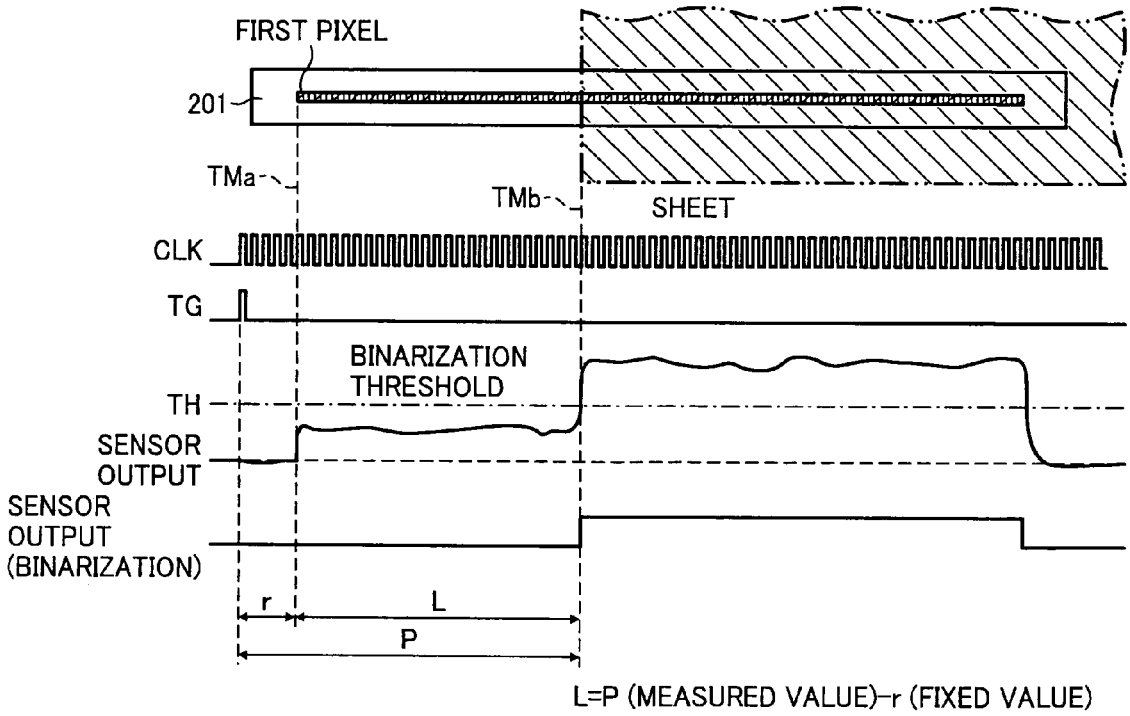
FIG. 10 is a schematic diagram for explaining detection of a sheet by the CIS.

FIG. 10 is a schematic diagram for explaining detection of a sheet by the CIS 201. When the CIS 201 receives a clock (CLK) and a trigger signal (TG), it starts operating. After a predetermined number of the clocks (r in FIG. 10) are received, an output from the CIS 201 is performed per one pixel by one clock from the first pixel. The higher is the reflectivity of the sheet, the higher will be the output level of a sensor output from the CIS 201. Therefore, when an analog sensor output from the CIS 201 is binarized by use of an appropriate threshold level (a binarization threshold (TH) in FIG. 10), the analog sensor output can be digitalized as a sheet "exists" or "absent". In an example shown in FIG. 10, because the sensor output of the CIS 201 is low at all time points from (TMa) to (TMb), the binarized output will have a low logical level, and after the time point TMb, where the sheet exists, because the sensor output is higher than the threshold level, the binarized output will have a high logical level. In detecting a sheet position, the number of the clocks from the trigger signal (TG) until the binarization output becomes high level (TMb) in FIG. 10) are counted, or a time from the trigger signal (TG) until the binarization output attains a high logical level is measured, i.e., distance (time) P in FIG. 10 is measured.

The position of the sheet is obtained from the first pixel (TMb) in FIG. 10) of the CIS 201 as the lateral registration sensor 414 by using the following Equation:

$$L=P-r \quad (1)$$

where L corresponds to L indicated in FIG. 9. Accordingly, the misregistration amount is obtained by use of "M−L". Here, P is a measured value while r is a fixed known value.

Figure 11:
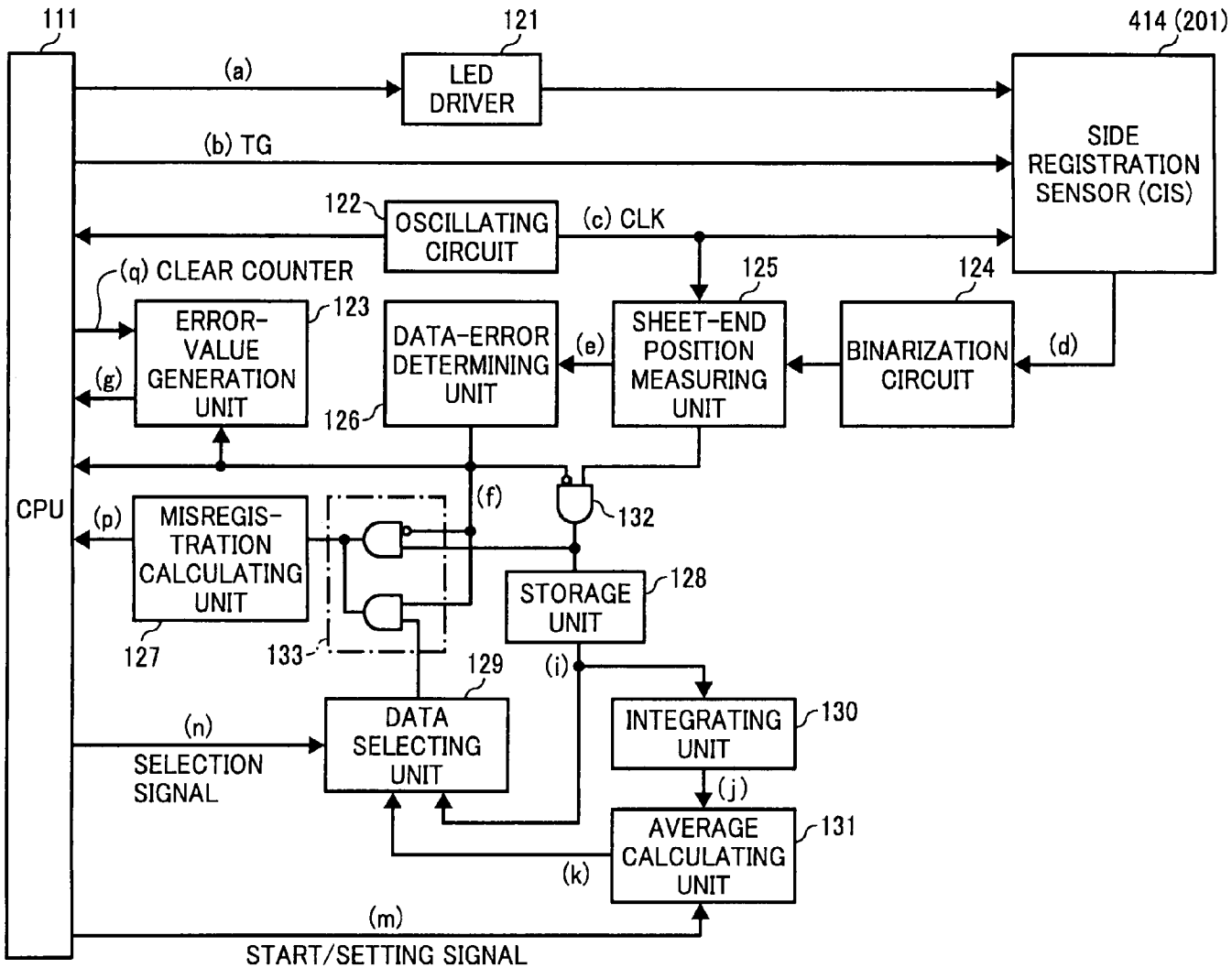
FIG. 11 is a block diagram of a lateral-misregistration detection circuit that detects lateral misregistration of a sheet.

FIG. 11 is a block diagram of a circuit configuration of a lateral-misregistration detection circuit for detecting lateral misregistration of a sheet. The CPU 111 is a one-chip CPU and controls the sheet post-processing apparatus PD. Specifically, the CPU 111 (a) causes a light emitting diode (LED) driver 121 to output a control signal to the CIS 201, (b) outputs a trigger signal TG for a measurement start to the CIS 201, and (c) causes an oscillating circuit 122 to output a clock to the CIS 201.

Then, (d) an analog output from the CIS 201 is digitalized by a binarization circuit 124 and input to a sheet-end position measuring unit 125. The sheet-end position measuring unit 125 measures the number of the clocks (CLK) until the digitalized signal output from the binarization circuit 124 indicates a high logical level that corresponds to a sheet end, thereby measuring the sheet position. Subsequently, (e) the measured sheet position is input to a data-error determining unit 126. When the measured sheet position deviates from a theoretical sheet position determined from the sheet size, or the sheet end cannot be detected at all, the data-error determining unit 126 determines that an error has occurred. When an error has occurred, (f) the data-error determining unit 126 inputs an abnormal signal (1 at the abnormal time) to each gate circuit, the CPU 111, and an error-value generation counting unit 123.

The error-value generation counting unit 123 counts how many times an error signal has been output from the data-error determining unit 126 and (g) outputs the count to the CPU 111. Then, (g) the CPU 111 outputs a counter-clear signal to reset the count in the error-value generation counting unit 123. (e) A storage unit 128 stores therein the measured sheet position output from the sheet-end position measuring unit 125 via a gate circuit 132 when a normal signal (0 at the normal time) is output from the data-error determining unit 126.

When storing the measured sheet position in the storage unit 128, the measured sheet position can be stored with respect to each sheet size, or can be classified into groups depending on job content. When (m) the CPU 111 outputs a start/setting signal to an average calculating unit 131, (i) an integrating unit 130 integrates data sent from the storage unit 128 and (j) sends integrated data to the average calculating unit 131. (k) The average calculating unit 131 then calculates an average. A misregistration calculating unit 127 calculates a misregistration amount of a sheet end. When the measured sheet position is normal, the sheet-end position measuring unit 125 inputs the measured sheet position to the misregistration calculating unit 127 via a gate circuit 133. When the measured sheet position is abnormal, (n) data selected by a data selecting unit 129 based on a selection signal from the CPU 111 is input to the misregistration calculating unit 127. (p) The misregistration calculating unit 127 calculates a misregistration amount of a sheet end, and then, and supplies the misregistration amount to the CPU 111. The CPU 111 drives the second stepping motor 423 by the amount corresponding to the misregistration amount to move the punching unit B to a correct position.

Figure 12:
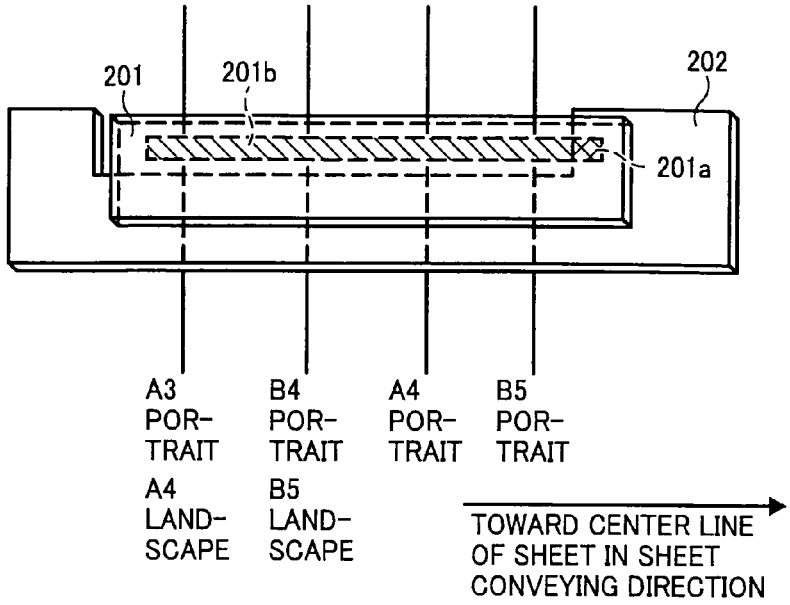
FIG. 12 is a schematic diagram illustrating reference conveying positions of sheets of various sizes.

Returning to the explanation of FIG. 3, the shielding plate 202 as a shielding unit is arranged in a measurement area of the sheet-end position measuring unit 125. In other words, a projected end portion of the shielding plate 202 is arranged within a reading range (measurement area) R of the CIS 201. The shielding unit is not limited to the shielding plate 202. FIG. 12 is a schematic diagram illustrating reference conveying positions of sheets of various sizes. The shielding plate 202 shields an optical path from the CIS 201 to a reading object so that the CIS 201 reads a surface of the shielding plate 202 instead of the reading object. The reading range (measurement area) R corresponds to a range from the first pixel to the last pixel to be read by the CIS 201.

A sheet fed from the image forming apparatus PR is conveyed to one of the positions shown in FIG. 12, which are ideal layout positions, depending on the size of the sheet. However, skew or lateral misregistration usually occurs on the conveyed sheet. The skew and the lateral misregistration are corrected in the manner as described above.

The shielding plate 202 is arranged at a position closer to a center line of a sheet in the sheet conveying direction than a position of the side edge of a sheet of the minimum correctable size (in the embodiment, B5 portrait). It is necessary to consider a distance of lateral misregistration that can be corrected, an assembly error of the CIS 201, and an assembly error of the shielding plate 202 when assembling the shielding plate 202. With this arrangement, the shielding plate 202 can be assuredly detected by using binarized data obtained by the CIS 201. In an example shown in FIG. 12, a portion of the CIS 201 shielded by the shielding plate 202 is a detection portion 201*a* by which the shielding plate 202 is detected, and the rest of the CIS 201 is a non-detection portion 201*b*.

Figure 13:
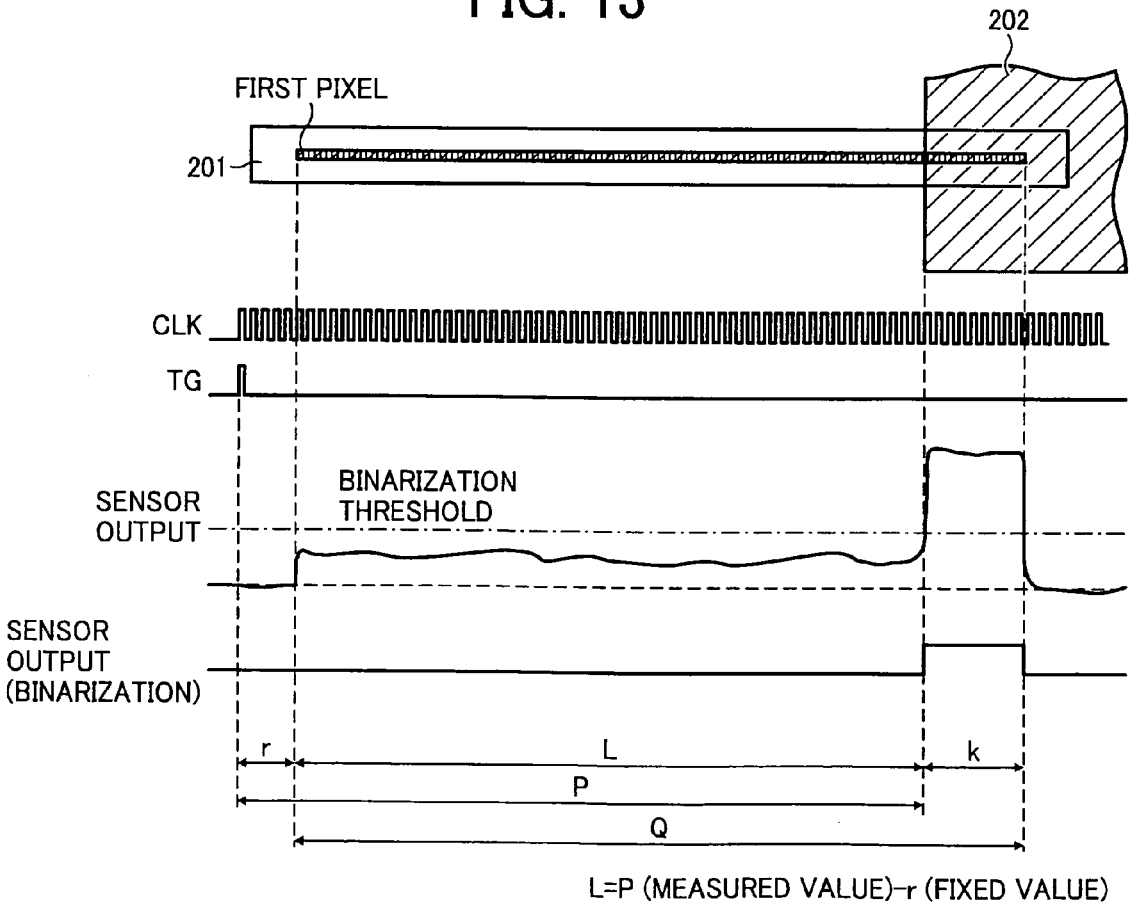
FIG. 13 is a schematic diagram for explaining detection of the shielding plate by the CIS in the situation shown in FIG. 12.

FIG. 13 is a schematic diagram for explaining detection of the shielding plate 202 by the CIS 201. The shielding plate 202 can be detected based on a calculated value L shown in FIG. 13. A positional relation between the CIS 201 and the shielding plate 202 is known from the mechanical layout. Therefore, the position of the shielding plate 202 can be represented by a parameter k in FIG. 13, where k corresponds to a distance from an end portion of the shielding plate 202 to an end portion of elements (photodetecting elements) of the CIS 201.

Whether the shielding plate 202 is detected can be determined by the following Inequality:

$$k-\alpha \leqq Q-L \leqq k+\alpha \quad (2)$$

where α represents an assembly error in the mechanical layout, Q is a parameter representing a readable length of the CIS 201, and L represents the calculated value. If Inequality (2) is satisfied, it is determined that the shielding plate 202 has been detected. If mounting failure of a connector of the CIS 201 occurs, or if the CIS 201 is broken, the sensor output from the CIS 201 becomes zero (Q−L=0). Therefore, Inequality (2) is not satisfied. In this case, it is determined that the shielding plate 202 has not been detected, which indicates an abnormal state.

Figure 14:
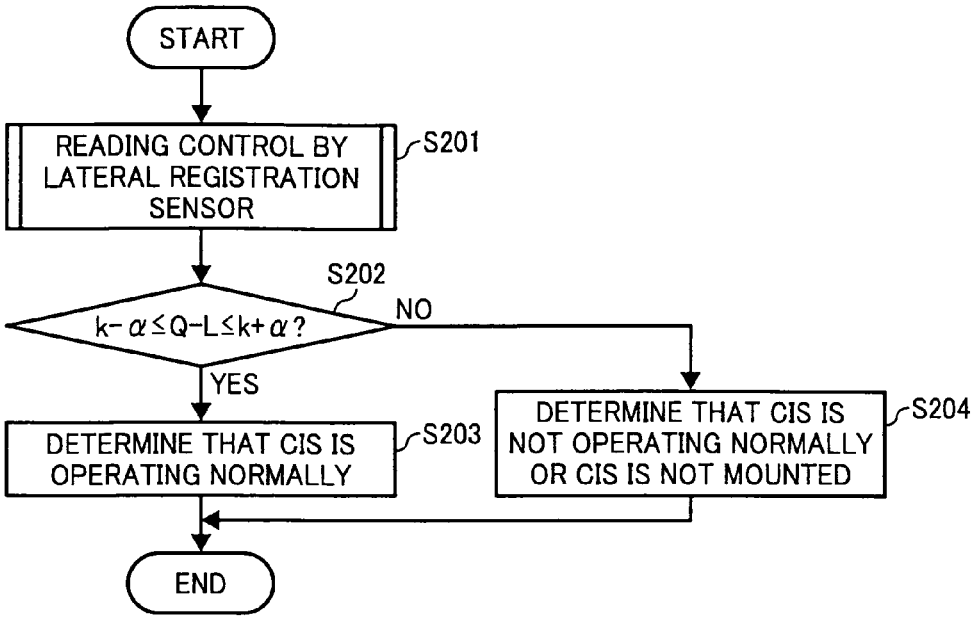
FIG. 14 is a flowchart of a control process for detecting the shielding plate in the situation shown in FIG. 13.

FIG. 14 is a flowchart of a control process for detecting the shielding plate 202.

When detecting the shielding plate 202, the lateral registration sensor 414 performs reading control to acquire the values L, P, Q, k, and r as described above in connection with FIG. 13 (Step S201). In the embodiment, the CIS 201 that is employed as the lateral registration sensor 414 performs the reading control. Whether Inequality (2) is satisfied is determined based on the acquired values (step S202). If Inequality (2) is satisfied (YES at Step S202), it is determined that the CIS 201 is operating normally (Step S203). If Inequality (2) is not satisfied (NO at Step S202), it is determined that the CIS 201 is not operating normally, or that the CIS 201 is not mounted at all (Step S204).

Figure 15:
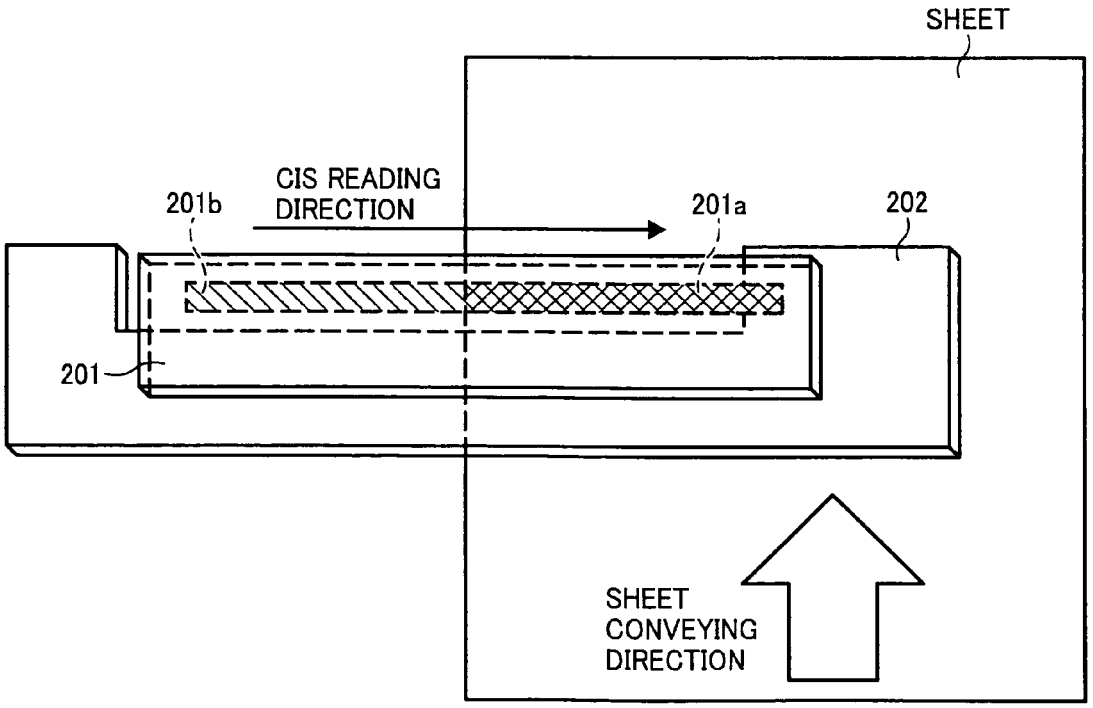
FIG. 15 is a schematic diagram illustrating a positional relation among the CIS, a conveyed sheet, and the shielding plate.
Figure 16:
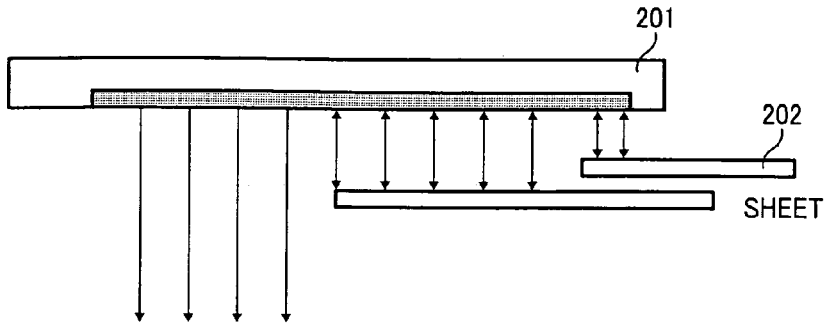
FIG. 16 is a side view of the CIS, the conveyed sheet, and the shielding plate in the situation shown in FIG. 15.
Figure 17:
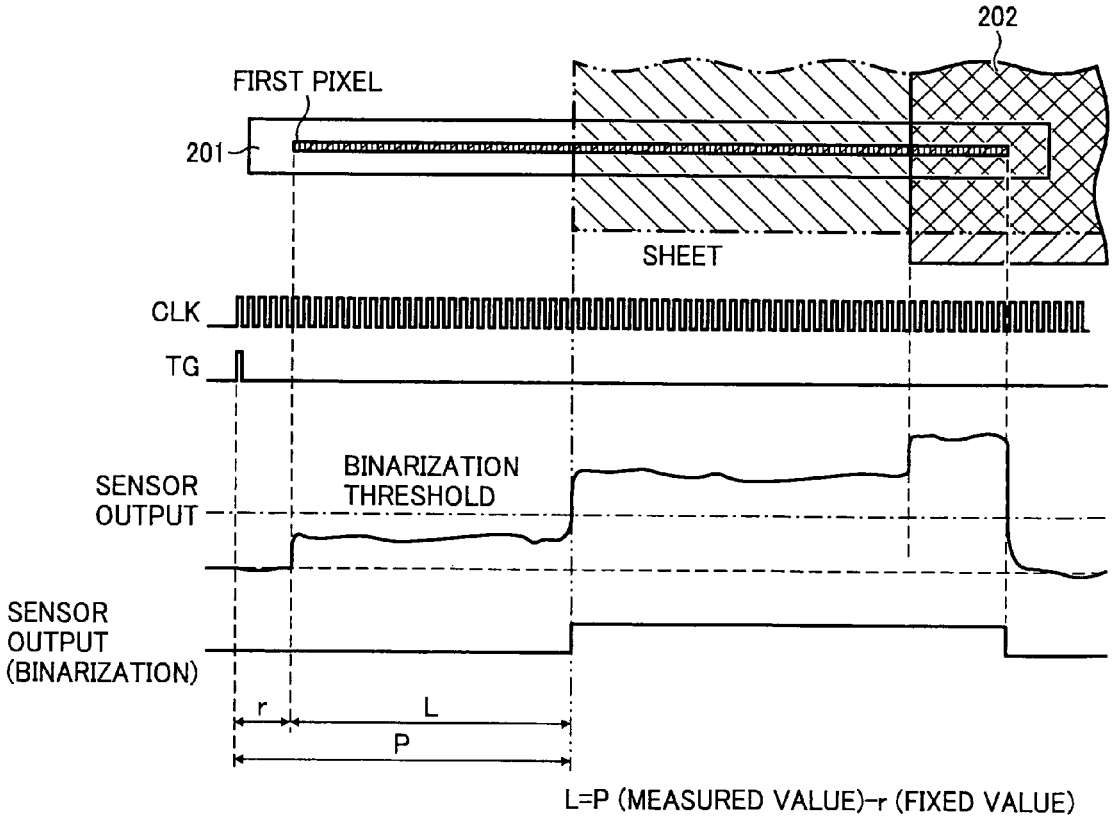
FIG. 17 is a schematic diagram for explaining detection of the sheet by the CIS in the situation shown in FIGS. 15 and 16.

FIG. 15 is a schematic diagram illustrating a positional relation among the CIS 201, a conveyed sheet, and the shielding plate 202. FIG. 16 is a side view of the conveyed sheet, the CIS 201, and the shielding plate 202 in the situation shown in FIG. 15. FIG. 17 is a schematic diagram for explaining detection of the sheet by the CIS 201 in the situation shown in FIGS. 15 and 16. As described above, the shielding plate 202 is arranged at a position closer to the center line of the sheet in the sheet conveying direction than a side edge of a sheet of the minimum size that is available for skew correction. Therefore, as shown in FIG. 17, the binarized output from the side edge of a sheet to the center line of the sheet in the sheet conveying direction is at a high logical level regardless of whether the shielding plate 202 is provided. In this case, the side edge of the sheet can always be detected.

Figure 18:
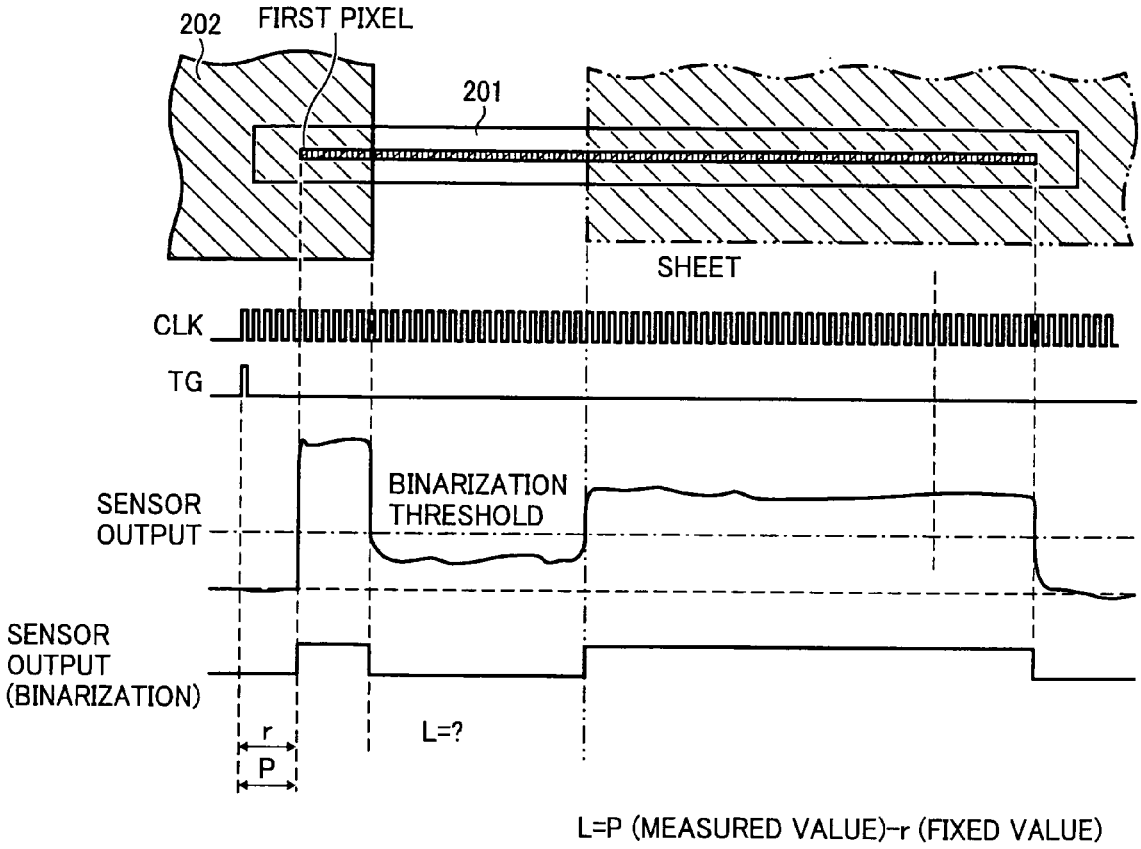
FIG. 18 is a schematic diagram for explaining detection of the sheet and the shielding plate by the CIS where the shielding plate is arranged on the side opposite to the side of a center line of a sheet in a sheet conveying direction.

Assuming that the shielding plate 202 is arranged on the side opposite to the side of the center line of the sheet in the sheet conveying direction, an end portion of the shielding plate 202 is at a position closer to the center line of the sheet in the sheet conveying direction than the first pixel of the CIS 201. FIG. 18 is a schematic diagram for explaining detection of the sheet and the shielding plate 202 by the CIS 201 in the above situation. As shown in FIG. 18, both the shielding plate 202 and the sheet are detected due to binarization. At this state, even when the value P from the trigger signal until a binarization output becomes high logical level is measured, the value L is not obtained from Equality (1). That is, L becomes zero, which does not make sense. Therefore, when the shielding plate 202 is arranged on the side opposite to the side of the center line of the sheet in the sheet conveying direction, only the shielding plate 202 can be detected and the position of the side edge of a sheet cannot be measured.

Returning to the explanation of FIG. 15, the shielding plate 202 is arranged such that the end portion of the shielding plate 202 is at a position closer to the center line of the sheet in the sheet conveying direction than the side edge of a sheet. At this time, as shown in FIG. 16, the shielding plate 202 is arranged closer to the CIS 201 than sheet. Accordingly, it is not necessary to adjust the light intensity of the CIS 201 for detecting the shielding plate 202. Furthermore, with the above configuration, when the binarization circuit 124 digitalizes the analog output from the CIS 201, the analog output of the shielding plate 202 always becomes larger than that of the sheet as long as the light intensity is adjusted for the sheet. Therefore, the shielding plate 202 can always be detected.

The operation of the CIS 201 can be checked by communication between the image forming apparatus PR and the sheet post-processing apparatus PD.

Examples of methods for checking the operation of the CIS 201 are described below.

One method is to instruct input check by the image forming apparatus PR. Upon receiving the instruction about the input check of the CIS 201 from the image forming apparatus PR, the sheet post-processing apparatus PD checks the CIS 201. The sheet post-processing apparatus PD sends 0 to the image forming apparatus PR when the CIS 201 is in an abnormal state and sends 1 to the image forming apparatus PR when the CIS 201 in a normal state. The abnormal state can be detected based on whether the shielding plate 202 has been detected. When the CIS 201 is in the abnormal state, the image forming apparatus PR displays an error notice on the operation panel 113 to notify the situation to users.

Another method is to perform the input check every time the sheet post-processing apparatus PD is turned on so that a notice is sent to the image forming apparatus PR only when the CIS 201 is in the abnormal state. With this method, the sheet post-processing apparatus PD can be notified that the CIS 201 is in the abnormal state even when a notice is not sent from the image forming apparatus PR.

In the above description, the examples in which the CIS 201 is used are explained because of the assumption that the CIS 201 is employed as the lateral registration sensor 414. However, the same configuration can be attained by using other sensors such as a line sensor and a CCD sensor.

The present invention is not limited to the specific details and examples described in the above embodiments. Accordingly, various modifications can be made without departing from the scope of the present invention.

According to the embodiment, following advantages can be obtained:

1) The mounting state and the operating state of the measuring unit (the CIS 201) can be checked without performing trial processes on a sheet.

2) The CIS 201 can perform reading control by arranging the shielding plate 202 within a sheet conveying path.

3) Because the shielding plate 202 is arranged closer to the CIS 201 than the sheet, it is not necessary to adjust the light intensity of the CIS 201.

4) Upon determining that the measuring unit (the CIS 201) is not mounted at all, an error notice can be sent to the image forming apparatus PR.

According to one aspect of the present invention, a position of the end portion of the shielding unit is measured in a measurement area, and determination process is performed based on a measurement result. Therefore, the setting state and the operating state of the measuring unit can be checked without performing trial processes on a sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a conveying unit that conveys a sheet in a sheet conveying direction;

a measuring unit that measures a position of a side edge of the sheet in a measurement area;

a shielding unit having an end portion that is projected into the measurement area for shielding the sheet;

a first determining unit that determines whether the shielding unit is detectable in the measurement area; and a second determining unit that determines whether the measuring unit has been mounted in the sheet conveying device based on a result obtained in the first determining unit.

2. The sheet conveying device according to claim 1, wherein the measuring unit includes a plurality of photodetecting elements arranged in a line and along with a detection area corresponding to the measurement area, and the measuring unit measures a position of a side edge of a sheet conveyed in the detection area or a position of the end portion of the shielding unit based on a signal output from the photodetecting elements.

3. The sheet conveying device according to claim 2, wherein the first determining unit determines that the shielding unit is detectable when following inequality is satisfied, $$k-\alpha \leqq Q-L \leqq k+\alpha$$

where L is a value calculated by the measuring unit and representing a distance from a first pixel of the photodetecting elements to the end portion of the shielding unit, k represents a distance from the end portion of the shielding unit to a last pixel of the photodetecting elements, α represents an assembly error of the photodetecting elements and the shielding unit, Q represents a length of the detection area.

4. The sheet conveying device according to claim 1, wherein the shielding unit is arranged at a position closer to a center line of a sheet in the sheet conveying direction than a position of a side edge of a sheet of a minimum size that can be measured by the measuring unit.

5. The sheet conveying device according to claim 1, wherein a distance from the measuring unit to the shielding unit is set shorter than a distance from the measuring unit to a sheet conveyed by the conveying unit.

6. The sheet conveying device according to claim 1, wherein the measuring unit performs a measurement with respect to a trailing end of a sheet conveyed by the conveying unit.

7. The sheet conveying device according to claim 2, wherein the photodetecting element is any one of a contact image sensor, a line sensor, and a charge coupled device sensor.

8. A punching device comprising:

a punching unit that punches a sheet conveyed by the sheet conveying device according to claim 1.

9. The punching device according to claim 8, further comprising an adjusting unit that adjusts a position of the punching unit by moving the punching unit in a direction perpendicular to the sheet conveying direction based on a measurement result from the measuring unit.

10. A sheet processing device comprising:

a processing unit that performs a predetermined processing on a sheet conveyed by the sheet conveying device according to claim 1.

11. The sheet processing device according to claim 10, wherein the processing unit performs at least one of punching, aligning, side-stitching, saddle-stitching, and center-folding on the sheet.

12. An image forming apparatus comprising the sheet conveying device according to claim 1.

13. An image forming apparatus comprising the punching device according to claim 8.

14. An image forming apparatus comprising the sheet processing device according to claim 10.

15. The image forming apparatus according to claim 12, further comprising:

an operation panel including a display unit, wherein when the second determining unit determines that the measuring unit is not mounted, an error notice is displayed on the operation panel.

16. The image forming apparatus according to claim 13, further comprising:

an operation panel including a display unit, wherein when the second determining unit determines that the measuring unit is not mounted, an error notice is displayed on the operation panel.

17. The image forming apparatus according to claim 14, further comprising:

an operation panel including a display unit, wherein when the second determining unit determines that the measuring unit is not mounted, an error notice is displayed on the operation panel.

18. A method for determining whether a measuring unit is mounted in a sheet conveying device that includes a conveying unit that conveys a sheet in a sheet conveying direction;

a measuring unit that measures a position of a side edge of the sheet in a measurement area; and a shielding unit having an end portion that is projected into the measurement area for shielding the sheet, wherein the method comprising:

first determining including determining whether the shielding unit is detectable in the measurement area; and second determining including determining whether the measuring unit is mounted based on a result obtained at the first determining.

* * * * *